US007395704B2

(12) United States Patent
DiFoggio

(10) Patent No.: US 7,395,704 B2
(45) Date of Patent: Jul. 8, 2008

(54) METHOD AND APPARATUS FOR DOWNHOLE FLUID ANALYSIS USING MOLECULARLY IMPRINTED POLYMERS

(75) Inventor: Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 184 days.

(21) Appl. No.: 10/994,579

(22) Filed: Nov. 22, 2004

(65) Prior Publication Data

US 2005/0109098 A1 May 26, 2005

Related U.S. Application Data

(60) Provisional application No. 60/524,431, filed on Nov. 21, 2003.

(51) Int. Cl.
*E21B 49/08* (2006.01)

(52) U.S. Cl. ..... 73/152.42

(58) Field of Classification Search ..... 73/152.42, 73/152.18, 152.55
See application file for complete search history.

(56) References Cited

U.S. PATENT DOCUMENTS

| | | | | |
|---|---|---|---|---|
| 4,406,792 | A | 9/1983 | Glad et al. | |
| 4,415,655 | A | 11/1983 | de Castro et al. | |
| 4,532,232 | A | 7/1985 | Larsson et al. | |
| 4,935,365 | A | 6/1990 | Nilsson et al. | |
| 4,960,762 | A | 10/1990 | Sellergren et al. | |
| 5,015,576 | A | 5/1991 | Nilsson et al. | |
| 5,110,883 | A | 5/1992 | Gartner | |
| 5,153,439 | A | 10/1992 | Gozani et al. | |
| 5,208,155 | A | 5/1993 | Mosbach et al. | |
| 5,310,648 | A | 5/1994 | Arnold et al. | |
| 5,321,102 | A | 6/1994 | Loy et al. | |
| 5,351,532 | A * | 10/1994 | Hager | 73/152.55 |
| 5,372,719 | A | 12/1994 | Afeyan et al. | |
| 5,416,024 | A * | 5/1995 | Smith | 436/32 |
| 5,881,807 | A | 3/1999 | Boe et al. | |
| 5,990,684 | A * | 11/1999 | Merrill | 324/439 |
| 6,232,783 | B1 * | 5/2001 | Merrill | 324/439 |
| 6,336,353 | B2 * | 1/2002 | Matsiev et al. | 73/24.06 |
| 6,341,498 | B1 | 1/2002 | DiFoggio | |
| 6,356,205 | B1 * | 3/2002 | Salvo et al. | 340/853.3 |
| 6,478,950 | B1 * | 11/2002 | Peat et al. | 205/775 |
| 6,672,163 | B2 * | 1/2004 | Han et al. | 73/597 |

(Continued)

FOREIGN PATENT DOCUMENTS

| | | | |
|---|---|---|---|
| JP | 05142152 A | * | 6/1993 |
| SU | 1452963 | | 2/1987 |
| WO | WO 0198630 A1 | * | 12/2001 |
| WO | WO03/034043 A2 | | 4/2003 |

OTHER PUBLICATIONS

Piletsky et al., "Molecular imprinting: at the edge of the third milenium," Jan. 2001, vol. 19, No. 1 pp. 9-12.*

(Continued)

*Primary Examiner*—Hezron E. Williams
*Assistant Examiner*—John Fitzgerald
(74) *Attorney, Agent, or Firm*—Madan, Mossman & Sriram, P.C.

(57) ABSTRACT

The present invention provides a downhole method and apparatus using molecularly imprinted polymers to analyze a downhole fluid sample or determine the percentage of oil based mud filtrate contamination in a formation fluid sample.

36 Claims, 4 Drawing Sheets

U.S. PATENT DOCUMENTS

| | | | | |
|---|---|---|---|---|
| 6,740,216 | B2 * | 5/2004 | Diakonov et al. | 204/418 |
| 6,798,518 | B2 * | 9/2004 | DiFoggio et al. | 356/416 |
| 6,817,229 | B2 * | 11/2004 | Han et al. | 73/64.53 |
| 6,872,786 | B2 * | 3/2005 | Murray et al. | 525/326.7 |
| 6,938,470 | B2 * | 9/2005 | DiFoggio et al. | 73/152.24 |
| 7,062,958 | B2 * | 6/2006 | Diakonov et al. | 73/152.23 |
| 7,100,689 | B2 * | 9/2006 | Williams et al. | 166/264 |
| 2002/0066309 | A1 * | 6/2002 | Tubel et al. | 73/152.54 |
| 2002/0178805 | A1 * | 12/2002 | DiFoggio et al. | 73/152.55 |
| 2002/0194906 | A1 * | 12/2002 | Goodwin et al. | 73/152.46 |
| 2003/0129092 | A1 | 7/2003 | Murray | |
| 2003/0134426 | A1 * | 7/2003 | Jiang et al. | 436/121 |
| 2003/0143119 | A1 | 7/2003 | Schwartz et al. | |
| 2003/0205083 | A1 * | 11/2003 | Tubel et al. | 73/152.19 |
| 2003/0209058 | A1 | 11/2003 | Merrill | |
| 2004/0045350 | A1 * | 3/2004 | Jones et al. | 73/152.23 |

OTHER PUBLICATIONS

Guo, et al., "Adsorptive Separation Of Hemoglobin By Molecularly Imprinted Chitosan Beads", Biomaterials 25 (2004) 5905-5912.

Lawrence et al., "Cortisol Sensor For Soldier Stress And Fatigue Monitoring", John Hopkins University.

Murray et al., "Molecularly Imprinted Polymers For The Selective Sequestering And Sensing Of Ions", John Hopkins APL Technical Digest, vol. 18, No. 4, 1997, pp. 464-472.

Ramanaviciene et al., Molecularly Imprinted Polypyrrole For Sensor Design, ISSN 1392-1320 Materials Science, vol. 10, No. 1, 2004, pp. 18-23.

* cited by examiner

METHOD AND APPARATUS FOR DOWNHOLE FLUID ANALYSIS USING MOLECULARLY IMPRINTED POLYMERS

CROSS REFERENCE TO RELATED APPLICATIONS

This patent application claims priority from U.S. provisional patent application Ser. No. 60/524,431 filed on Nov. 21, 2003.

BACKGROUND OF THE INVENTION

1. Field of the Invention

The present invention relates to the field of downhole formation fluid sample analysis in hydrocarbon producing wells. More particularly, the present invention relates to a method and apparatus for analyzing downhole fluid samples using molecularly imprinted polymer sensors (MIPS) for analyzing a formation fluid sample and determining the composition of downhole fluid samples including the percentage of filtrate contamination in a formation fluid sample.

2. Background of the Related Art

In wellbore exploration, drilling mud such as oil-based mud and synthetic-based mud types are used. The filtrates from these mud types generally invade the formation through the borehole wall to an extent, meaning that this filtrate must be removed as well as it can be removed from the formation by pumping in order to access the formation fluids after filtrate has been pumped out. Open hole sampling is an effective way to acquire representative reservoir fluids. Sample acquisition allows determination of critical information for assessing the economic value of reserves. In addition, optimal production strategies can be designed to handle these complex fluids. In open hole sampling, initially, the flow from the formation contains considerable filtrate, but as this filtrate is drained from the formation, the flow increasingly becomes richer in formation fluid. That is, the sampled flow from the formation contains a higher percentage of formation fluid as pumping continues.

It is well known that fluid being pumped from a wellbore undergoes a clean-up process in which the purity of the sample increases over time as filtrate is gradually removed from the formation and less filtrate appears in the sample. When extracting fluids from a formation, it is desirable to quantify the cleanup progress, that is, the degree of contamination from filtrate in real time. If it is known that there is too much filtrate contamination in the sample (for example, more than about 10%), then there is may be no reason to collect the formation fluid sample in a sample tank until the contamination level drops to an acceptable level. Thus, there is a need for a method and apparatus for directly analyzing a fluid sample and determining percentage of filtrate contamination in a sample.

Molecularly imprinted polymer sensors (MIPS) are now being used to analyze gases in laboratory settings at 1 atmosphere and at room temperature. U.S. Patent Application Publication No. 20030129092 by Murray, published Jul. 10, 2003, (hereinafter "Murray"), which is incorporated herein by reference in its entirety, describes a molecularly imprinted polymer solution anion sensor for measuring and detecting a wide variety of analytes.

As described in Murray, methods and apparatus for the efficient and accurate detection and quantification of analytes, including polyatomic anion analytes, are of particular interest for use in a wide range of applications. For example, such methods and apparatus are useful in the detection, monitoring, and management of environmental pollutants, including organophosphorus-based pesticides. Organophosphorus-based pesticides, including paraoxon, parathion, and diazinon are widely used in the agriculture industry. Because such materials exhibit a relatively high toxicity to many forms of plant and animal life, and also exhibit relatively high solubility in water, organophosphorus-based pesticides pose a clear threat to aquatic life and to our drinking water. Accordingly, it is imperative to be able to accurately monitor the levels of pesticides in industrial waste waters, agricultural runoffs, and other environments to determine compliance with federal and state regulations, and other safety guidelines.

Additional applications for MIPS are described in *Molecularly Imprinted Polymer Sensors and Sequestering Agents,* Johns Hopkins University Applied Physics Laboratory, which states that, plastics are an increasingly common part of everyday life. Most of what we consider to be plastics are organic polymers, consisting of long chains, or networks, of small carbon compounds linked together to form long heavy molecules, or macromolecules. The familiar "plastics" are typically polymers that are formed in the absence of a solvent, by a method called bulk polymerization. Bulk polymerization results in masses of entwined or networked strands to form a solid substance. The rigidity of the solid can be controlled by a process known as "crosslinking". Crosslinking is obtained when one of the building blocks of the polymer (a monomer) has the ability to tie two or more of the strands together. The addition of crosslinking monomers forms a three dimensional network polymer that is more rigid than an uncrosslinked polymer and is insoluble in organic solvents. The greater the proportion of crosslinking monomer, the harder, or more rigid, the resulting plastic.

Polymers are common in nature and provide many of the structural molecules in living organisms. Many of the natural polymers, such as cellulose, chitin and rubber, have been employed by man to make fabrics and to use as structural materials. Some natural polymers, like rubber, are being supplanted by a large variety of synthetic polymers. An understanding of polymer structure and composition has allowed chemists to make polymers with specific desired physical properties. This is the reason why synthetic polymers have in many cases replaced other materials and natural polymers. Synthetic polymers can be made more durable and longer lasting. Their specific properties can be tailored to a purpose and so, as in the case of natural rubber, synthetic polymers can be produced that are vast improvements to their natural counterparts.

A fairly recent direction in synthetic polymer development is the introduction of molecular imprinted polymers (MIPs). These materials trace their origin back to suppositions about the operation of the human immune system by Stuart Mudd in the 30's and Linus Pauling in the 40's. Mudd's contribution was to propose the idea of complementary structures. That is to say the reason a specific antibody attacks a specific target or "antigen", is because the shape of the antibody provides an excellent fitting cavity for the shape of the antigen. This description is very similar to the "lock and key" analogy used to explain the action of enzymes, the molecules responsible for hastening and directing biochemical reactions. In this case, the enzyme forms the lock for a particular chemical key to fit, and as this "key" is turned, the enzyme directs and hastens the production of desired products from the chemical target.

Pauling's contribution to the development of MIPs was to explain the source of the complementary shape exhibited by antibodies. He postulated how an otherwise non-specific antibody molecule could be re-organized into a specific binding molecule. He reasoned that shape specificity was obtained by using the target antigen to arrange the complementary shape of the antibody. Thus a nonspecific molecule shapes itself to the contours of a specific target and, when the target is removed, the shape is maintained to give the antibody a propensity to rebind the antigen. This process is now known as molecular imprinting or "templating".

Molecularly imprinted polymers are made by first building a complex of a target molecule and associated attached binding molecules that possess the ability to be incorporated into a polymer. The complex is usually dissolved in a larger amount of other polymerizable molecules. The bulk of the other molecules for the polymer is made with special molecules called crosslinking monomers. These molecules have two places to bind to the polymer chain to form a rigid three dimensional structure. The crosslinkers are necessary to hold the complexing molecules in place after the target molecule or "template" is removed. It is also usual to add a solvent to the mixture. The solvent molecules get caught up in the growing polymer and leave gaps and pores in the structure to make the target complexes more accessible after the polymer is formed. Typically, after polymerization, a chunk of plastic is obtained. This chunk is ground up into a powder and the target molecule is removed by washing it out with the right solvent. The powder is left with special holes that have a memory for the target molecule are ready to recapture that specific molecule the next time it comes along.

The key step in making a MIP is to form a complex that will survive the polymerization process and leave behind a suitable set of binding sites when the target is removed. If this doesn't happen the final product won't have any memory, it's memory will be blurred and inexact and so the polymer will also bind the wrong molecules. Much of this procedure was mapped out by Professor Wulff in his early experiments. A few variations on this procedure have appeared recently directed at having surface active polymers where porosity is avoided. This is to obtain an increase in the speed of binding with a concomitant loss in capacity for binding in order to make fast responding sensors.

At present, there is no known direct methodology for accurately analyzing a downhole fluid sample or for quantifying the presence of an analyte, such as oil based mud filtrate contamination of the crude oil in samples that are collected with a wireline formation tester or an analyte ratio such as phytane-pristine ratios. Thus, there is a need for a method and apparatus for directly analyzing a sample or determining the percentage of oil based mud filtrate contamination of the crude oil in samples in a downhole environment

SUMMARY OF THE INVENTION

The present invention provides a downhole method and apparatus using molecularly imprinted polymer (MIP) sensors to estimate a property of a fluid sample or to quantify the presence of oil based mud filtrate in a formation fluid sample. The present invention provides a source of flushing fluid to remove an adsorbed analyte and re-zero the response of the molecularly imprinted polymer. For example, for oil-based mud filtrate analysis, the present invention flushes an MIP sensor with a light hydrocarbon such as hexane or decane. For analytes in downhole brine, the present invention flushes the MIP sensor with fresh water. Alternatively, the present invention heats the MIPS to desorb adsorbed analytes.

DETAILED DESCRIPTION OF THE INVENTION

Figure 1:
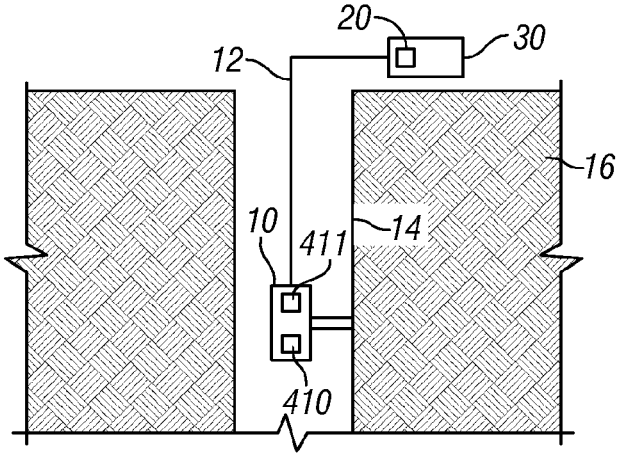
FIG. 1 is a schematic diagram of an embodiment of the present invention deployed on a wireline in a downhole environment.

At present there is no direct way to analyze a fluid sample or quantify the presence of oil based mud filtrate contamination of the crude oil in samples as they are collected downhole in a wireline or drill string deployed formation testing instrument. Molecularly imprinted polymer sensors (MIPS), which selectively respond to the mud filtrate but not to crude oil, are used to provide semi-quantitative estimates of oil base mud filtrate contamination. Additional other uses for MIPS for trace analysis or for tracer detection are provided by the present invention. Geochemists can determine the amount of particular biomarkers, such as the phytane to pristine ratio of a crude oil.

A plurality of MIP sensors are available for use with the present invention. In one aspect the present invention provides a method and apparatus for using a high-temperature (200° C.+) carbon-loaded conducting polymer sensors (one example of a MIP sensor) that respond only to one particular molecule by swelling and changing their resistivity. This is done by mixing the monomer with an analyte, polymerizing the monomer, then extracting the analyte, to leave behind "holes" into which only the analyte molecules can "fit". This method achieves extraordinary sensor selectivity to the analyte, which is comparable to the selectivity of immunoassay techniques. The present invention uses a variety of MIP sensors suitable for adaptation for downhole use. Examples of suitable MIP sensors for adaptation for downhole use by the present invention are a MIP resistivity sensor such as the sensor developed by Draper Labs at the Massachusetts Institute of Technology or an optical sensor as shown in U.S. Patent application publication 2003/0129092 A1. Another example of a suitable MIP sensor is to provide a MIP sensor manufactured from out of an intrinsically conducting polymer (polypyrrole) that can be used as an electrode in pulsed amperometric detection, such as Ramanaviciene, et. al. (ISSN 1392-1320 Materials Science, Vol. 10, No. 1, 2004). Murry, et. al. (Johns Hopkins APL Technical Digest, Volume 18, Number 4, 1997) describe MIP sensor based polymer membrane electrodes for detection of metallic ions such as lead, copper, cadmium, and zinc.

Presently MIP sensors have been developed by Draper laboratories that respond selectively in a laboratory environment to the vapor of a base oil of a synthetic mud but not to crude oil when placed in head space of air above a mixture of base oil and crude oil. These Draper Laboratories MIP sensors can be adapted for use in the present invention for downhole estimation of the amount of oil-based mud contamination in samples of crude oil as they are being collected downhole using a formation tester deployed from a wireline or drill string. In the one example of the invention, the MIP sensors are immersed in liquid and flushed clean with a provided solvent fluid such as hexane, decane, or other fluids that are dissimilar from the base oil.

Molecular imprinting is a useful technique for making a chemically selective binding site. The method involves building a synthetic polymeric scaffold of molecular compliments containing the target molecule with subsequent removal of the target to leave a cavity with a structural "memory" of the target. Molecularly imprinted polymers can be employed as selective adsorbents of specific molecules or molecular functional groups. The imprinted polymers can be fashioned into membranes that can be used to form ion selective electrodes for the imprinted molecular ion. By incorporating molecules or metal ions with useful optical properties in the binding sites of imprinted polymers, spectroscopic sensors for the imprinted molecule are made. Sensors for specific biomolecules are made using optical transduction through chromophores residing in the imprinted site. The combination of molecular imprinting and spectroscopic selectivity has resulted in sensors that are highly sensitive and immune to interferences. See, e.g., $29^{th}$ Am. Soc. Photobiology, D. Lawrence.

Figure 2:
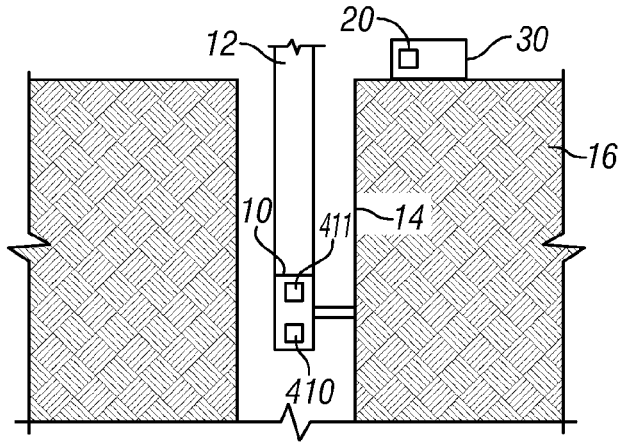
FIG. 2 is a schematic diagram of an embodiment of the present invention deployed on a drill string in a monitoring while drilling environment.

As used herein, the term "molecularly imprinted polymer" or "MIP" refers generally to a polymeric mold-like structure having one or more pre-organized recognition sites which complement the shape of at least a portion of a target or imprint molecule and which contain interactive moieties that complement the spacing of, and exhibit an affinity for, at least a portion of the binding sites on the target or imprint molecule. As will be recognized by those of skill in the art, MIP sensors are typically formed by coordinating imprint molecules with one or more functional monomers to form imprint/monomer complexes (wherein the imprint molecule interacts or bonds with a complementary moiety of the functional monomer via covalent, ionic, hydrophobic, hydrogen-bonding, or other interactions). The monomer/imprint complexes are then polymerized into a highly cross-linked polymer matrix, and the imprint molecules are subsequently dissociated from the functional monomers and removed from the polymer matrix to leave cavities or recognition sites that are relatively shape specific to the imprint molecules and which contain complementary moieties having the ability to rebind chemically with the imprint molecule. FIG. 2 of Murray shows a schematic representation of one method of molecular imprinting showing self assembly of an imprint to form a imprint complex; incorporation of the imprint complex into the polymer matrix; removal of the imprint molecule; and formation of the imprinted cavity.

The combination of the shape specificity of the cavities formed in the MIP and the affinity of the moieties associated with the MIP cavities for the target molecule results in the polymer exhibiting selective binding characteristics for the imprint substance. The terms "selective binding characteristics" and "selective binding interactions" are intended to refer to preferential and reversible binding exhibited by an imprinted polymer for its imprint molecule compared to other non-imprint molecules. Selective binding includes both affinity and specificity of the imprinted polymer for its template molecule.

According to certain embodiments, the MIP sensors of the present invention comprise lanthanide-containing polymeric structures that exhibit selective binding characteristics towards an analyte to be detected by a sensor device of the present invention (a "target analyte"). The present invention provides MIP sensors that can be used advantageously as part of an analytical device, such as an optical sensor device, to selectively capture target analyte molecules, by associating such molecules with the MIP lanthanide binding sites, from an analyte solution for detection of the target analyte by the sensor. The present invention provides MIP sensors that act not only to provide a site for selectively rebinding the target analyte, but also, act as a source of lumninescence, which can be analyzed to determine the amount of target analyte in an analyte solution. The present chelated lanthanides can be sensitized to absorb light energy, including light in the blue region of electromagnetic spectrum, from a variety of light sources, including low-cost LEDs, and to luminesce with an enhanced, detectable intensity. As target analytes are associated with the lanthanides in the present example of the MIP sensor of the present invention, the intensity of a certain luminescence line will vary with the amount of anion bound to the polymer (wherein the an amount bound in the MIP is in equilibrium with amount in solution). Such characteristic luminescence can be detected and analyzed to determine the amount of target analyte in solution according to the present invention.

A MIP can be prepared via any of a wide range of well known methods including those described in U.S. Pat. Nos. 5,110,883; 5,321,102; 5,372,719; 5,310,648; 5,208,155; 5,015,576; 4,935,365; 4,960,762; 4,532,232; 4,415,655; and 4,406,792, the entire disclosures of which are incorporated herein by reference in their entirety.

Figure 3:
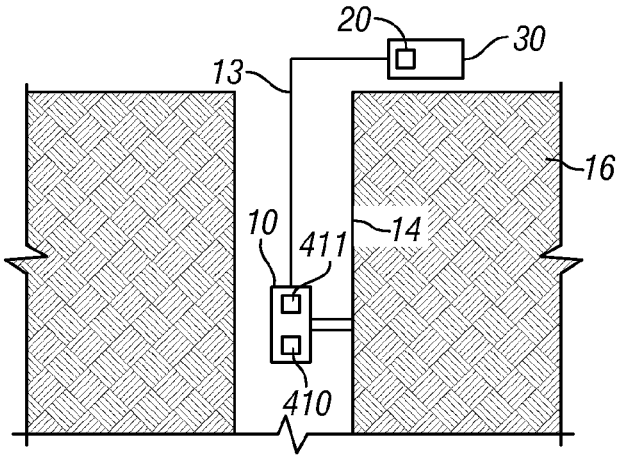
FIG. 3 is a schematic diagram of an embodiment of the present invention deployed on a flexible tubing in a downhole environment.

Turning now to FIG. 1, FIG. 1 is a schematic diagram of a preferred embodiment of the present invention deployed on a wireline in a downhole environment. As shown in FIG. 1, a downhole tool 10 containing a processor 411 and MIPS monitoring device 410 is deployed in a borehole 14. The borehole is formed in formation 16. Tool 10 is deployed via a wireline 12. Data from the tool 10 is communicated to the surface to a surface computer processor 20 with memory inside of an intelligent completion system 30. FIG. 2 is a schematic diagram of a preferred embodiment of the present invention deployed on a drill string 15 in a monitoring while drilling environment. FIG. 3 is a schematic diagram of a preferred embodiment of the present invention deployed on a flexible tubing 13 in a downhole environment.

Figure 4:
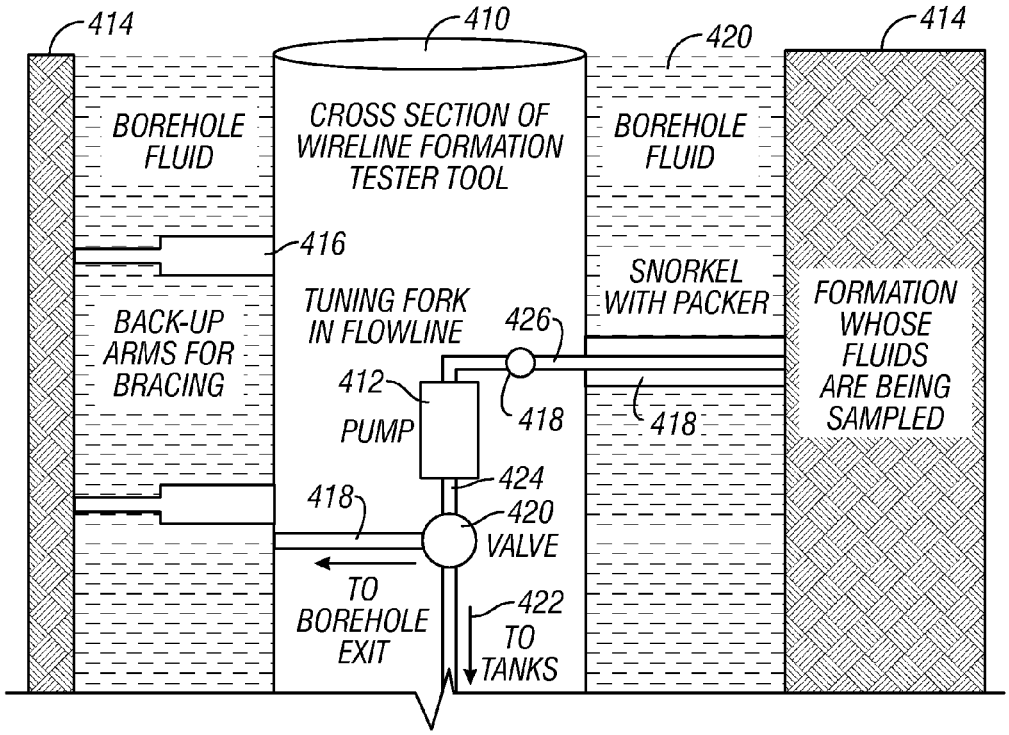
FIG. 4 is a schematic diagram of an embodiment of the present invention as deployed in a wireline downhole environment showing a cross section of a wireline formation tester tool.

FIG. 4 is a schematic diagram of an exemplary embodiment of the present invention as deployed in a wireline downhole environment showing a cross section of a wireline formation tester tool. As shown in FIG. 4, tool 10 is deployed in a borehole 420 filled with borehole fluid. The tool 10 is positioned in the borehole by backup support arms 416. A packer with a snorkel 418 contacts the borehole wall for extracting formation fluid from the formation 414. Tool 416 contains MIPS 410 disposed in flow line 426. MIP sensors which have been adapted to be suitable for deployment in the downhole tool of the present invention under downhole pressure and temperature are suitable for use with the present invention. Pump 412 pumps formation fluid from formation 414 into flow line 426. Formation fluid travels through flow line 424 into valve 420 which directs the formation fluid to line 422 to save the fluid in sample tanks or to line 418 where the formation fluid exits to the borehole.

Figure 5:
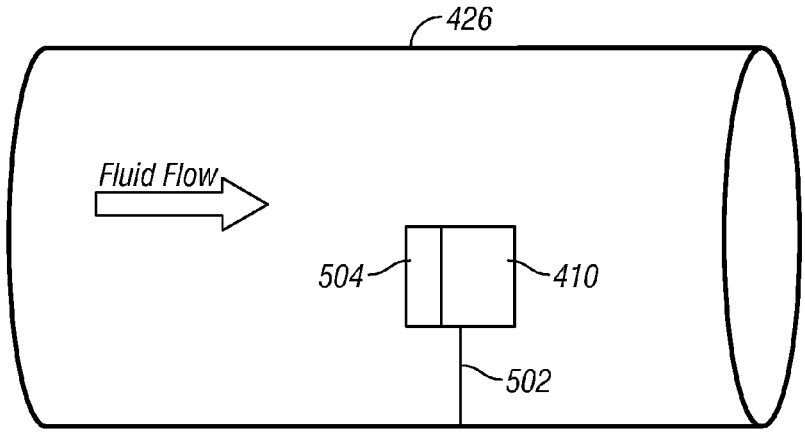
FIG. 5 is an illustration of a MIPS in a fluid flow stream in an embodiment.

FIG. 5 is an illustration of a MIP sensor 410 deployed in a formation fluid flow line 422. The MIP sensor 410 connects via data path 502 to processor 411 for determination of the contamination level or analysis of the fluid sample. When necessary, a sorption cooling device 504 as described in U.S. Pat. No. 6,341,498 by DiFoggio and co-owned by applicant is provided to cool the MIP sensor during downhole operations. A MIP sensor suitable for use with the present invention can be selected from a wide variety of MIP sensors that currently or in the future can be manufactured or purchased. Two examples of a suitable MIP sensors are an optical sensor as described in Murray and a resistivity MIPS sensor available from Draper Laboratories at MIT. A wide variety of MIP sensor suitably adapted for downhole pressures and temperatures is suitable for use in the present invention. MIP sensors are also in development and available from MIP Technologies AB in Research Park Ideon in Lund, Sweden. Further discussion of MIPS applications and technology is provided in *Molecular Imprinting: From Fundamentals to Applications,* Komiyama, et al. ISBN: 3-527-30569-6, which is incorporated herein by reference in its entirety.

Figure 6:
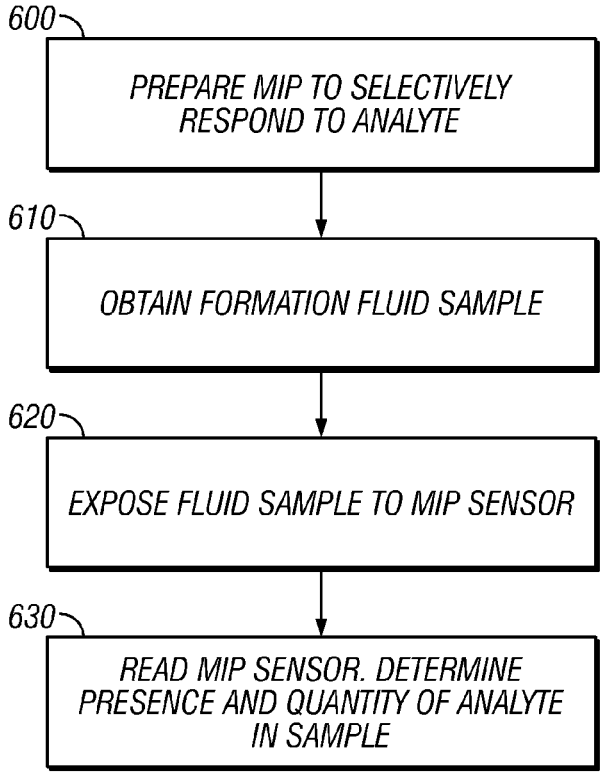
FIG. 6 is a flow chart for analyzing a fluid sample using a molecularly imprinted polymer sensor.

FIG. 6 is a flow chart describing the process for preparing a MIPS and analyzing a formation fluid sample. As shown in 600, a MIPS is prepared to selectively respond to an analyte. In 610 a formation fluid sample is obtained. In 620 the fluid sample is exposed to an MIP sensor having the MIP which selectively responds to the analyte. In 630 the processor reads the MIP sensor to determine the presence and quantity of the analyte in the sample.

Samples are taken from the formation by pumping fluid from the formation through a flow line and into a sample cell. Filtrate from the borehole normally invades the formation and consequently is typically present in formation fluid when a sample is drawn from the formation. As formation fluid is pumped from the formation the amount of filtrate in the fluid pumped from the formation diminishes over time until the sample reaches its lowest level of contamination. This process of pumping to remove sample contamination is referred to as sample clean up. In one embodiment, the present invention indicates that a formation fluid sample clean up is complete (contamination has reached a minimum value) when the quantity of filtrate detected has leveled off or become asymptotic within the resolution of the measurement of the tool for a period of twenty minutes to one hour.

The MIP sensor is used to estimate filtrate contamination by detecting the dominant chemical used in the base oil of the filtrate or by detecting any of the chemicals added to the base oil, such as the emulsifiers, surfactants, or fluid loss materials. A sample of well bore fluid can be taken to determine an identifying characteristic of the well bore fluid.

This MIP sensor can also quantify trace amounts of gases such as H2S, or trace amounts of metals, such as mercury, nickel or vanadium in either crude oil or formation brines. Furthermore, subtle differences in the chemical composition of two samples of crude oil obtained from different depths or sections in the well could be used as an indicator that those sections are compartmentalized from one another.

Multi-billion dollar decisions on how to develop a reservoir (well locations, types of production facilities, etc.) are based on whether or not a reservoir is compartmentalized. As the name implies, compartmentalization of a reservoir simply means that different sections of a reservoir are separate compartments across which fluids do not flow. Separate compartments must be drained separately and may need different types of processing for their fluids. In like manner, it can be important to assess reservoir compartmentalization of aqueous zones when planning waste water injection wells.

An example of a subtle chemical difference that could be indicative of compartmentalization would be a change in the ratio of trace hydrocarbons such as phytane/pristine. Any other unexpected compositional differences could also indicate compartmentalization. Gravity segregation will cause some expected spectral differences in fluids from different depths even when there is no compartmentalization. For example, one expects the top of a column of crude oil to have a higher concentration of natural gas dissolved in it than does the bottom of the column.

Figure 7:
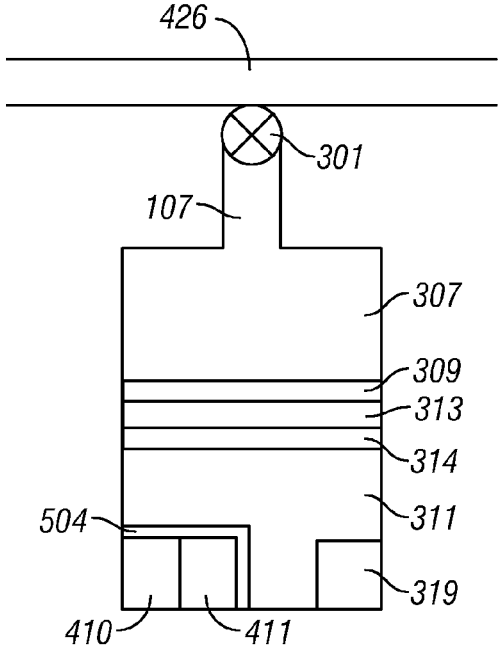
FIG. 7 is an illustration of a MIP sensor in a gaseous environment separated from a liquid by a membrane.
Figure 8:
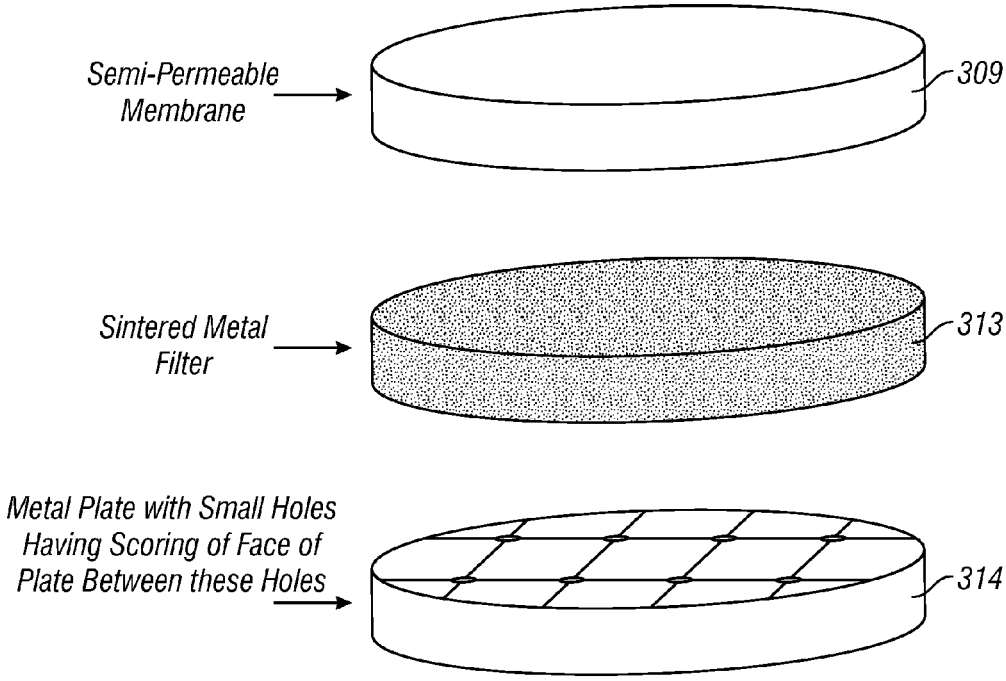
FIG. 8 is an illustration of a membrane for use in the present invention.

As shown on FIG. 7, for some analytes, such as H2S, it may be desirable to operate the MIPS in a vacuum chamber 702 behind a gas permeable membrane 704 that blocks liquid and is adequately supported by plate 706 to withstand downhole pressure as is described in a pending application by DiFoggio and co-owned by applicant, Ser. No. 60/553,921 filed on Mar. 17, 2004 entitled Downhole Mass Spectrometer System For Compositional Fluid Analysis. A flow chart for analyzing a gas in a vacuum for the system shown in FIG. 7, is shown in FIG. 8.

The present invention exposes downhole high-temperature and high-pressure formation fluids to a semi-permeable membrane, which blocks liquids but allows passage of certain gases and vapors. This membrane is mechanically supported by a rigid but porous and permeable structure such as a sintered metal filter followed by a metal plate having some holes in it that is capable of withstanding the pressure difference between vacuum and downhole pressures. The semi-permeable membrane is made of a material such as silicone rubber, which permits the diffusion of gases and certain vapors from the formation fluid sample, through the membrane and into a vacuum chamber adjacent the semi-permeable membrane.

Turning now to FIG. 7, a more detailed schematic of the present invention is shown. An MIP sensor 410, ion pump 319, semi-permeable membrane 300, fluid containment chamber 307 and processor 411 are shown in schematic form in FIG. 3. A sorption-cooling unit 321 is provided to maintain processor and the MIP sensor within their operating and/or survival temperature range. The formation fluid containment chamber 307 is separated from the evacuated gas analysis chamber 311 by the semi-permeable membrane 309. Thus, the formation fluid containment chamber 307 is positioned on one side of the semi-permeable membrane 309 and an evacuated gas analysis chamber 311 on the other side of the semi-permeable membrane 309. The gases trapped in the captured formation fluid sample diffuse across the semi-permeable membrane into the evacuated gas analysis chamber for analysis.

Formation fluid is extracted from the formation and enters into the fluid containment chamber 307 via flow line 426 and valve 301. Gases diffuse from the formation fluid on the fluid side of the semi-permeable membrane, through the semi-permeable membrane and into the evacuated chamber 311. The MIP sensor 410 and processor/control electronics 411 are located in the evacuated chamber 311. The gas is exposed to the MIP sensor 410 and processor. The processor 411 monitors the MIP sensor conducts the analysis. The processor 411 reports the analytical results to the surface via the wire line of other means of downhole communication. The processor 411 can act on the analysis results without reporting the results to the surface. FIG. 8 illustrates the semi-permeable membrane 309, sintered metal filter 313 and metal plate 314 with small hole having scoring of fact of plate between the holes. The processor also employs a neural network or other soft modeling technique to estimate a property of the fluid or gas.

Figure 9:
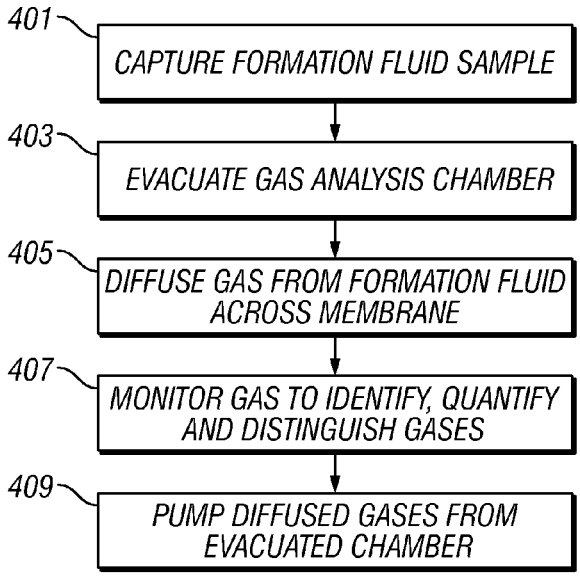
FIG. 9 is a flow chart for analyzing a gaseous sample using a molecularly imprinted polymer sensor.

Turning now to FIG. 9, an example illustrating some of the functions performed by the present invention is illustrated. As shown in block 401, the present invention captures a formation fluid sample from the formation. The formation fluid enters the tool via a flow line in fluid communication with the formation. In block 403, the gas chamber is evacuated. The evacuation of the gas chamber enables gases trapped in the formation fluid sample to diffuse into the evacuated chamber through the semi-permeable membrane. In block 405 the semi-permeable membrane between the fluid and the evacuated chamber allows gases from the fluid to diffuse through the semi-permeable membrane into an evacuated gas analysis chamber. In block 407, the MIP sensor 410 and processor 411 of the present invention monitors the gases to detect, identify and quantify the gases and distinguish between them. In block 409, the ion pump removes diffused gases from the evacuated side of the chamber to maintain the vacuum. In either case of analyzing a fluid or a gas, the MIP sensor enables the estimating of a fluid property based on the response of the MIP sensor to the fluid or gas. The pressure of the fluid may suffice to allow gases to diffuse through the membrane without evacuating the chamber.

There are a variety of ways in which the amount of adsorbed analyte can be detected. For example, the MIPS sensor could be loaded with conducting graphite and its resistance change associated with swelling from exposure to analyte could be monitored. Alternatively, a layer of MIPS could be applied to the end of an optical fiber or as a cladding substitute over part of the optical fiber. Analyte adsorption would change the refractive index of the MIPS layer thus changing the light reflection from the end of the fiber or the light leakage out of the core of the fiber. For analytes that fluoresce, an ultraviolet or other excitation light source could be launched in the fiber and the amount of fluorescence detected. The MIPS could also be made of a conducting polymer such as polypyrrole and used in pulsed amperometric detection.

The equilibrium concentration of adsorbed analyte will depend on the concentration of the analyte remaining in solution and on the temperature as would be expected by the Langmuir or Freundlich equations (Guo, et. al., Biomaterials, 25 (2004) 5905-5912). The MIPS can be regenerated by flushing with fluids that are initially free of analyte but which have a high affinity for the analyte. The approach to the equilibrium concentration of analyte generally follows an exponential rise (or fall) to an asymptotic level as described by Ramanaviciene, et. al, 2004, in a paper that also gives equations for calibrating a MIPS sensor.

In another embodiment, the method of the present invention is implemented as a set computer executable of instructions on a computer readable medium, comprising ROM, RAM, CD ROM, Flash or any other computer readable medium, now known or unknown that when executed cause a computer to implement the method of the present invention.

While the foregoing disclosure is directed to the preferred embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

What is claimed is:

1. An apparatus for estimating a property of a gas diffused from a downhole fluid comprising:

a flow line receiving the downhole fluid;

a chamber receiving the downhole fluid from the flow line;

a pump evacuating the chamber;

an analyte selective sensor in communication with the gas diffused from the downhole fluid in the chamber; and a processor that uses a characteristic of the sensor to estimate the property of the gas diffused from the downhole fluid.

2. The apparatus of claim 1, wherein the analyte selective sensor is a molecularly imprinted polymer (MIP) sensor.

3. apparatus of claim 1, further comprising:

a gas permeable membrane positioned in the chamber.

4. The apparatus of claim 1, wherein the sensor adsorbs an analyte associated with the gas diffused from the downhole fluid.

5. The apparatus of claim 1, further comprising:

a desorber that substantially removes an adsorbed analyte from the sensor.

6. The apparatus of claim 1, further comprising:

at least one of the set consisting of: (i) a heater and; (ii) a flushing fluid to cause the sensor to desorb an absorbed analyte.

7. The apparatus of claim 1, wherein the response from the sensor comprises at least one of the set consisting of a luminescence, resistance, fluorescence, an electrical characteristic and light leakage.

8. The apparatus of claim 1, wherein the processor estimates at least one of compartmentalization and filtrate fraction using the property of the gas diffused from the downhole fluid.

9. The apparatus of claim 1, wherein the processor uses a neural network.

10. The apparatus of claim 1 further comprising: a membrane diffusing the gas from the downhole fluid and being supported from a downhole pressure by one of (i) a porous member, and (ii) a permeable member.

11. The apparatus of claim 1 further comprising: a membrane diffusing the gas from the downhole fluid and dividing the chamber into a first chamber receiving the downhole fluid and a second chamber receiving the diffused gas.

12. The apparatus of claim 11 the pump is an ion pump.

13. A method for estimating a property of a gas diffused from a downhole fluid, comprising:

flowing the downhole fluid through a flow line;

evacuating a chamber in communication with the flow line to cause a vacuum pressure in the chamber;

receiving the downhole fluid from the flow line into the chamber;

exposing an analyte selective sensor in the chamber to the gas diffused from the down hole fluid; and estimating the property of the gas diffused from the downhole fluid based on a response associated with the sensor.

14. The method of claim 13, wherein the sensor comprises a molecularly imprinted polymer (MIP) sensor.

15. The method of claim 13, wherein the exposing comprises:

positioning a gas permeable membrane in the chamber; and diffusing the gas from the downhole fluid through the gas permeable-membrane.

16. The method of claim 13, wherein exposing further comprises sorbing on the sensor an analyte associated with the gas diffused from the downhole fluid.

17. The method of claim 13, further comprising:

desorbing an adsorbed analyte from the sensor.

18. The method of claim 13, further comprising:

at least one of heating and flushing the sensor to desorb an adsorbed analyte from the sensor.

19. The method of claim 13, wherein the response associated with the sensor comprises at least one of the set consisting of a luminescence, resistance, an electrical characteristic fluorescence and light leakage.

20. The method of claim 13, further comprising:

estimating at least one of the set consisting of compartmentalization and filtrate fraction using the property of the gas diffused from the downhole fluid.

21. The method of claim 13, wherein the estimating comprises at least one of the set consisting of using a chemometric equation and neural network to estimate the property of the gas diffused from the downhole fluid.

22. The method of claim 13 further comprising:

diffusing the gas from the downhole fluid through a membrane supported from a downhole pressure by one of (i) a porous member, and (ii) a permeable member.

23. The method of claim 13 further comprising:

dividing the chamber into a first chamber receiving the downhole fluid and a second chamber receiving the diffused gas with a membrane; and diffusing the gas from the downhole fluid through the membrane.

24. The method of claim 23 further comprising:

evacuating the second chamber with an ion pump.

25. A system for estimating a property of a gas diffused from a downhole fluid comprising a bore transecting a zone containing the down hole fluid;

a wireline conveyed downhole tool;

a flow line associated with the downhole tool, the flow line receiving the downhole fluid pumped from the formation;

a chamber receiving the downhole fluid from the flow line;

a pump configured to evacuate the chamber and create a vacuum pressure in the chamber;

an analyte specific sensor associated with the gas diffused from the down hole fluid; and a processor that uses a response associated with the sensor and estimates the property of the gas diffused from the downhole fluid.

26. The system of claim 25, wherein the analyte specific sensor is a molecularly imprinted polymer (MIP) sensor.

27. The system of claim 25, further comprising:

a gas permeable membrane in the chamber.

28. The system of claim 25, wherein the sensor adsorbs an analyte associated with the gas diffused from the downhole fluid.

29. The system of claim 25, further comprising:

a desorber that substantially removes an adsorbed analyte from the sensor.

30. The system of claim 25, further comprising:

at least one of a heater or a flushing fluid that substantially desorbs an adsorbed analyte from the sensor.

31. The system of claim 25, wherein the response from the sensor comprises at least one of the set consisting of a luminescence, resistance, fluorescence, an electrical characteristic and light leakage.

32. The system of claim 25, wherein the processor estimates at least one compartmentalization and filtrate fraction using the property of the gas diffused from the downhole fluid.

33. The system of claim 25, wherein the processor comprises a neural network to estimate the property of the gas diffused from the downhole fluid.

34. The system of claim 25 further comprising: a membrane diffusing the gas from the downhole fluid and being supported from a downhole pressure by one of (i) a porous member, and (ii) a permeable member.

35. The system of claim 25 further comprising: a membrane diffusing the gas from the downhole fluid and dividing the chamber into a first chamber receiving the downhole fluid and a second chamber receiving the diffused gas.

36. The system of claim 35 the pump is an ion pump.

* * * * *